United States Patent [19]

Litkenhus et al.

[11] 4,101,224

[45] Jul. 18, 1978

[54] ESCAPEMENT MECHANISM FOR TYPEWRITERS

[75] Inventors: John Robert Litkenhus, Lawrenceburg; Donald Wayne Stafford, Lexington, both of Ky.

[73] Assignee: International Business Machines Corporation, Armonk, N.Y.

[21] Appl. No.: 770,129

[22] Filed: Feb. 18, 1977

[51] Int. Cl.[2] ..... B41J 19/20

[52] U.S. Cl. ..... 400/328; 400/320; 400/300

[58] Field of Search ..... 197/65, 66, 82, 83, 197/84 R, 89, 90, 91, 151, 176, 181, 187, 19

[56] References Cited

U.S. PATENT DOCUMENTS

| | | | |
|---|---|---|---|
| 3,630,336 | 12/1971 | Johnson et al. | 197/19 X |
| 3,750,797 | 8/1973 | Hunt et al. | 197/176 |
| 3,779,359 | 12/1973 | Morrison et al. | 197/90 X |

OTHER PUBLICATIONS

IBM Technical Disclosure Bulletin, "Printer with High—Speed Space Control," Tanner, vol. 12, No. 12, May 1970, pp. 2260–2261.

IBM Technical Disclosure Bulletin, "Electromechanical Left–Hand Final Stop," Baker et al., vol. 18, No. 7, Dec. 1975, pp. 2218–2219.

*Primary Examiner*—Ernest T. Wright, Jr.

*Attorney, Agent, or Firm*—William J. Dick

[57] ABSTRACT

Disclosed is a mechanism for replacing the non-escapement magnet normally utilized to inhibit escapement during certain machine functions on a typewriter. A detent arm is connected to the normal pawl knock-off arm so that upon the print shaft rotating and effecting, by a cam thereon, movement of associated linkage and motion of the knock-off arm to disengage the pawl from the ratchet wheel, the detent arm associated with the knock-off arm detents the ratchet wheel and inhibits escapement thereof until the linkage and knock-off arm returns to its normal position by rotation of the print shaft. Thus, if the escapement magnet coil is not energized, the pawl associated with the magnet will return to its normal position and the ratchet wheel will, because of the detent of the member associated with the knock-off arm, be inhibited from motion.

12 Claims, 4 Drawing Figures

ESCAPEMENT MECHANISM FOR TYPEWRITERS

SUMMARY OF THE INVENTION AND STATE OF THE PRIOR ART

The present invention relates to typewriters and more specifically relates to an escapement ratchet detent mechanism which inhibits escapement during certain machine functions on a typewriter.

In a typewriter of the type having a single element typing head, such as the IBM "Selectric" typewriter, certain machine functions require that the carrier does not move. For example, during erase functions, accent marking, shift operations and so forth it is desirable that the printhead carrier does not move.

The state of the prior art may best be understood by referring to the normal operation of conventional mechanism shown in FIG. 2. Upon depression of a typewriter key and through suitable linkages, bails, etc. the cycle shaft 1 of the machine rotates. Upon rotation of the cycle shaft 1, a cam 2 thereon also rotates, the rotation for every key depressed of the cam 2 and the print shaft 1 being 360°. A cam follower 3 which is connected through a bell crank or the like 4 causes the linkage 5 to be moved in the direction of the arrow upon the follower 3 moving to the high point of the cam 2. A ratchet wheel 6 is connected to the leadscrew 6*a* upon which is mounted a printhead carrier, the leadscrew 6*a* being connected to separate drive means to effect rotation thereof upon the ratchet wheel 6 being allowed to escape from the pawl 7. Linkage 5 includes a knock-off arm 5*a* which is pivoted in such a manner that upon the cam 2 reaching its high point, the pawl knock-off arm 5*a* removes or knocks off the pawl 7 permitting rotation of the leadscrew 6*a* and thus advancement of the printhead carrier. However, in the instances where an erase function occurs, the shift key is struck, etc., it is necessary to inhibit the rotation of the ratchet wheel 6 and thus the leadscrew 6*a* to prevent the printhead carrier from moving. However, upon depression of any of the keys of the typewriter the cycle shaft 1 normally rotates and thus the knock-off arm 5*a* depresses the pawl 7. To inhibit escapement of the ratchet wheel 6 therefore and prevent operations of the knock-off arm 5*a*, a dead key magnet assembly 8 is energized whenever it is desired that printhead carrier movement be inhibited. As shown, the dead key magnet assembly 8 has an armature 8*b* which, upon energization of the electromagnet 8*c*, is pulled toward the electromagnet 8*c* and prevents, by a projection 8*a* associated with the pawl knock-off arm 5*a* engaging the armature 8*b* of the electromagnet 8*c*, functioning of the pawl knock-off arm 5*a*. The conventional machine, such as the IBM Mag Card Executive or Mag Card II typewriter portion, also includes a second electromagnet 9 which serves to hold the pawl 7 disengaged any number of teeth of the ratchet wheel 6 depending upon how far the carrier is to move, which of course is dependent upon the letter spacing, proportional spacing, etc.

In view of the above, it is a principle object of the present invention to provide a simple mechanism which replaces the dead key magnet assembly described above with reference to in FIG. 3.

A further object of the present invention is to provide a simple and yet effective mechanism which operates to inhibit escapement unless the escapement magnet is energized so as to replace the dead key magnet assembly for such operations as shift, erase, accent marks, etc.

Other objects and a more complete understanding of the present invention may be had by referring to the following specification and claims taken in conjunction with the accompanying drawing in which;

Figure 1:
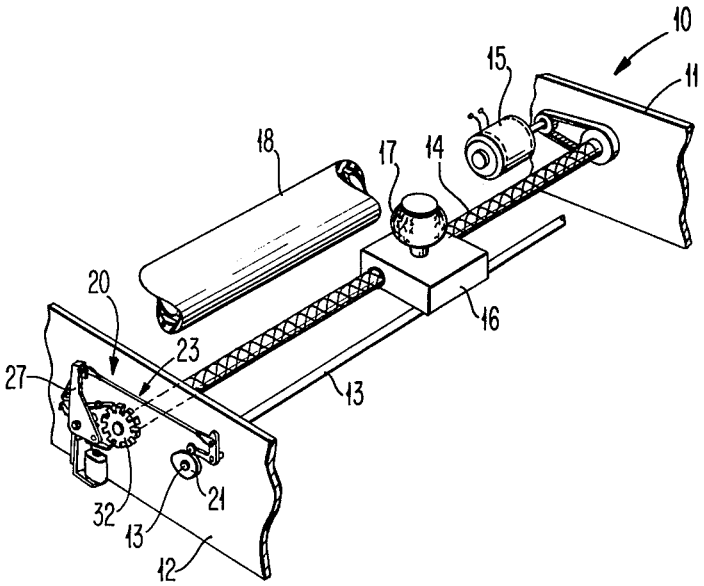
FIG. 1 is a fragmentary schematic perspective view of a portion of a single element typewriter and the mechanism which employs apparatus constructed in accordance with the present invention.
Figure 2:
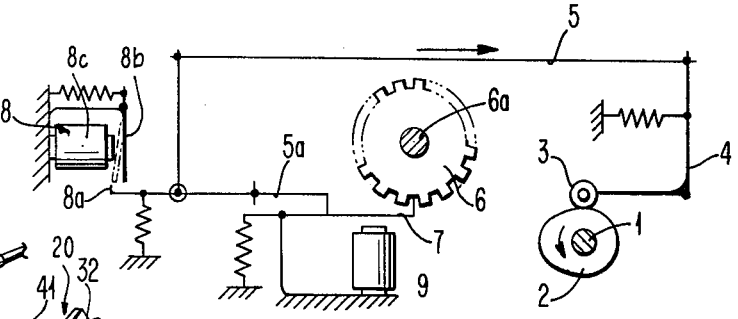
FIG. 2 (PRIOR ART)
FIG. 2 is a schematic representation of the prior art (discussed above)
Figure 3:
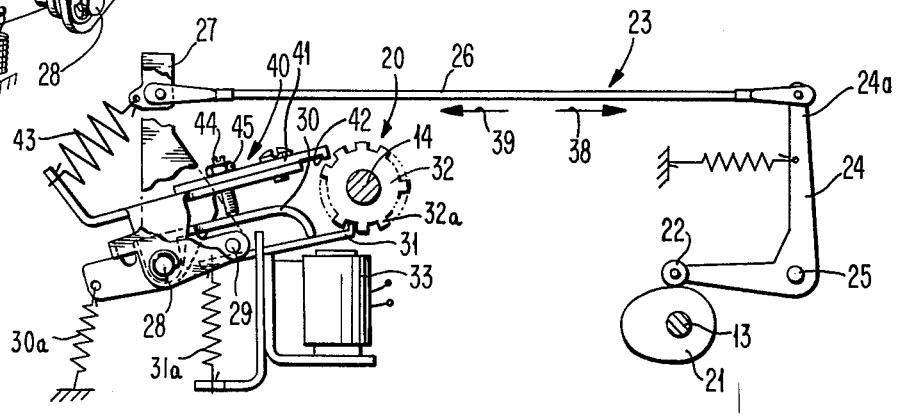
FIG. 3 is a fragmentary side elevational view illustrating an apparatus constructed in accordance with the present invention.

Turning now to the drawing, and especially FIG. 1 thereof, a portion of a typewriter 10 is shown therein, the typewriter comprising upstanding side frame members 11 and 12 respectively, a cycle shaft 13 which extends between the frame members 11 and 12 and which is cyclicly operated upon depression of the keys on the keyboard of the typewriter, one cycle every time a key is depressed; and a leadscrew 14 journaled for rotation between the frame members 11 and 12 and driven as by the drive means 15. As shown in FIG. 3, the leadscrew 14 is connected in driving relationship with a carrier (printhead) 16 and carries a single typing element 17 (sometimes referred to as a "ball") for making impressions through a ribbon (not shown) on paper against a platen 18. The leadscrew 14 is journaled in the frame member 12 and outboard thereof is an escapement mechanism 20 which permits rotation of the leadscrew 14.

In accordance with the invention, the detent mechanism (detent means 40) operates to inhibit rotation of the leadscrew 14 unless selectively operable means, in the present instance an escapement magnet 33, is energized so as to permit holding of the pawl or armature 31 out of engagement with the ratchet 32. To this end, and referring now to FIG. 3, as has previously been described a cam 21 is mounted on the cycle shaft 13, in the present instance outboard of the frame member 12. The cam 21 therefore rotates 360° every time the cycle shaft 13 rotates 360°. Biased against the cam 21 is a cam follower 22 which is connected to linkage 23 to effect movement thereof. As illustrated, the linkage 23 includes a bell crank or rocker arm 24 which is pivoted as at 25 so as to effect movement of a rod 26 pivotally connected to the opposite end 24*a* of the bell crank 24. The rod 26 is in turn connected to a bracket or the like 27 which forms part of the linkage 23 and is pivoted for rotation about an axle or shaft 28 so as to effect, upon the follower 22 being elevated upon the high point of the cam 21, clockwise motion of the bracket 27. Connected to the bracket 27, as by a pin or the like 29, is a pawl knock-off arm 30 which serves, as has previously been described relative to the prior art, to depress the pawl or armature 31 which normally stops or inhibits rotation of the leadscrew 14 by its engagement with a ratchet, in the illustrated instance a ratchet wheel 32.

As may be seen in FIG. 3, the pawl or armature 31 is normally biased into engagement with the ratchet wheel 32 as by a spring 31*a*, while the pawl knock-off arm 30 is biased upwardly (counterclockwise about pin 29 in FIG. 3) as by a tension spring 30*a*.

Figure 4:
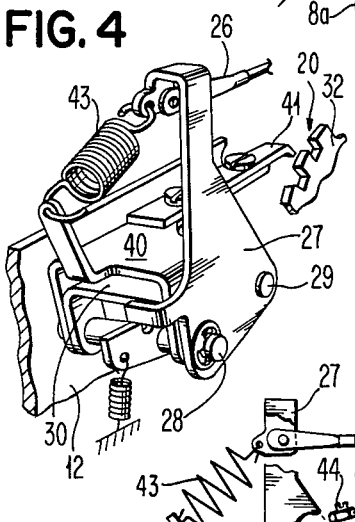
FIG. 4 is a fragmentary perspective view illustrating a portion of the mechanism illustrated in FIG. 3.

In normal operation, the pawl 31 is momentarily disengaged by the rotation of the cam 21 and the following thereof by the follower 22 allowing the ratchet wheel 32 to rotate. The number of teeth 32*a* escaped by the pawl 31 is dependent upon, in normal operation, whether or not the selectively operable means, in the illustrated instance an electromagnet 33 is energized and for the period of time of energization of the electromagnet 33. However, as has heretofore been explained, during certain operations such as shift, erase, the making of accent marks over a letter or the like, no escapement is desired or permitted. Accordingly, and in accordance with the invention, detent means 40, in the illustrated instance and comprising an arm 41 is mounted in pivoting relation to the bracket 27, the arm 41 including rachet engaging means, in the present instance a depending or projecting tip 42 dimensioned to fit between the teeth 32*a* of the ratchet wheel 32. The detent arm 41 is mounted for rotation about the shaft 28 and connected to the bracket 27 so as to be biased in a clockwise direction (FIGS. 3 and 4) by a biasing spring 43 which serves to permit limited relative movement between the knock-off arm 30 and the detent arm 41. The resilience afforded by the spring 43 permits the arm 41 to effect pressure against the ratchet wheel 32 in the event that the arm 41 strikes the tip of a tooth of the ratchet wheel 32 as opposed to the root of the teeth 32*a*. The position of the detent arm 41 relative to the knock-off arm 30 is set by adjustment means, in the illustrated instance by a simple set screw 44 including a nut 45.

In operation, as the linkage 23 moves in the direction of the arrow 38, the pawl knock-off arm 30 effects disengagement of the pawl 31 depressing the pawl 31 so as to permit rotation of the ratchet wheel 32. However, as the knock-off arm 30 is depressed by the cam 21 being elevated, the lip or tang 42 on the detent arm 41 engages the ratchet wheel 32 and inhibits its motion. If the typewriter is in the non-escapement mode, the selectively operable means or electromagnet 33 will not be energized so as to maintain its armature or pawl 31 in the depressed or out of engagement position, and as the cam 21 rotates into the dwell portion of the cycle, the linkage 23 will move in the direction 39 elevating the knock-off arm 30 and permitting the pawl 31 to once again engage the ratchet wheel 32 while effecting elevation of the detent arm 41. Thus the ratchet wheel 32 will not move in the non-escapement mode. However, in the event that the electromagnet 33 does hold down the pawl 31, the direction of motion 39 of the linkage 23 will still follow due to the rotation of the cam 21 and the detent arm 41 will be elevated allowing escapement of the ratchet wheel 32 until the electromagnet is released.

Thus the very simple escapement ratchet detent means 40 serves to inhibit rotation of the ratchet wheel 32 unless the escapement magnet 33 is energized.

Although the invention has been described with a certain degree of particularity, it is understood that the present disclosure has been made only by way of example and that numerous changes in the details of construction and the combination and arrangement of parts may be made without departing from the spirit and the scope of the invention as hereinafter claimed:

What is claimed is:

1. In a typewriter having a cyclicly rotatable print shaft, a driven leadscrew having a ratchet thereon, said leadscrew connected to a carrier containing a typing element thereon, and a pawl for engagement with said ratchet and normally biased to inhibit motion of said leadscrew;

a cam mounted for rotation with said print shaft, a cam follower engaging said cam and means interconnecting said cam follower and said pawl whereby on rotation of said print shaft said cam effects momentary disengagement of said pawl from said ratchet to permit rotation of said leadscrew and movement of said carrier, and means selectively operable for maintaining disengagement of said pawl from said ratchet a predetermined period of time; and detent means carried by said interconnecting means for engagement with said ratchet inhibiting movement thereof during momentary disengagement of said pawl from said ratchet whereby escapement of said ratchet and leadscrew is prevented unless said selectively operable means maintains disengagement of said pawl.

2. In a typewriter in accordance with claim 1 wherein said means interconnecting said cam follower and said pawl includes a pawl knock-off arm.

3. In a typewriter in accordance with claim 2 wherein said means interconnecting said cam follower and said pawl further includes a pivotally mounted bracket connected to said pawl knock-off arm, said detent means comprising another arm pivotally connected to said bracket, said other arm having ratchet engaging means thereon, and biasing means interconnecting said other arm and said bracket whereby as said bracket rotates so does said other arm.

4. In a typewriter in accordance with claim 3 including adjustment means to set the position of said other arm relative to said pawl knock-off arm.

5. In a typewriter in accordance with claim 4 wherein said adjustment means comprises a set screw mounted in one of said arms and engageable with the other of said arms.

6. In a typewriter having a cyclically rotatable print shaft, a driven leadscrew having a ratchet thereon, said leadscrew connected to a carrier containing a typing element thereon, and a pawl for engagement with said ratchet and normally biased to inhibit motion of said leadscrew;

a cam mounted for rotation with said print shaft;

a cam follower engaging said cam, and linkage means interconnecting said cam follower and said pawl whereby upon rotation of said print shaft said cam, cam follower and linkage means effect momentary disengagement of said pawl from said ratchet to permit rotation of said leadscrew and movement of said carrier, and a selectively operable electromagnet, said pawl forming the armature therefor;

said electromagnet, when energized, operable for maintaining disengagement of said pawl from said ratchet a predetermined period of time;

and detent means carried by said linkage for engagement with said ratchet inhibiting movement thereof during momentary disengagement of said pawl from said ratchet whereby escapement of said ratchet and leadscrew is prevented unless said electromagnet maintains disengagement of said pawl.

7. In a typewriter in accordance with claim 6 wherein said linkage means includes a pawl knock-off arm.

8. In a typewriter in accordance with claim 7 wherein said linkage means further includes a pivotally mounted bracket connected to said pawl knock-off arm, said detent means being mounted for rotation relative to said bracket.

9. In a typewriter in accordance with claim 8 wherein said detent means comprises another arm having ratchet engaging means thereon, means interconnecting said bracket and said other arm, and means for limiting relative movement between said other arm and said pawl knock-off arm.

10. In a typewriter in accordance with claim 9 wherein said means interconnecting said other arm and said bracket comprises a spring.

11. In a typewriter in accordance with claim 10 wherein said means for limiting relative movement between said arm and said pawl knock-off arm comprising adjustment means to set the position of said other arm relative to said pawl knock-off arm.

12. In a typewriter in accordance with claim 11 wherein said adjustment means comprises a set screw mounted in one of said arms and engageable with the other of said arms.

* * * * *